US009720382B2

(12) United States Patent
Nakanishi

(10) Patent No.: US 9,720,382 B2
(45) Date of Patent: Aug. 1, 2017

(54) ELECTRONIC TIMEPIECE

(71) Applicant: Seiko Epson Corporation, Tokyo (JP)

(72) Inventor: Nobuhiko Nakanishi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/519,718

(22) Filed: Oct. 21, 2014

(65) Prior Publication Data

US 2015/0146503 A1 May 28, 2015

(30) Foreign Application Priority Data

Nov. 28, 2013 (JP) ..... 2013-245797

(51) Int. Cl.
*G04G 9/00* (2006.01)
*G04R 20/02* (2013.01)

(52) U.S. Cl.
CPC ..... *G04G 9/0076* (2013.01); *G04R 20/02* (2013.01)

(58) Field of Classification Search
CPC ..... G04G 9/0076
See application file for complete search history.

(56) References Cited

U.S. PATENT DOCUMENTS 3,115,002 A * 12/1963 Beresford ..... G04B 19/22 368/191
5,210,721 A * 5/1993 Kikuchi ..... G04B 27/00 368/21
5,708,628 A * 1/1998 Chen ..... G04B 19/22 368/21
6,243,324 B1 * 6/2001 Teng ..... G04B 19/22 368/21
6,788,622 B1 * 9/2004 Garcia ..... G04B 19/22 368/21
7,733,743 B2 * 6/2010 Choi ..... G06G 1/08 368/21
8,077,550 B2 * 12/2011 Akiyama ..... G04G 5/002 368/21
9,025,419 B2 * 5/2015 Lechot ..... G04B 19/22 368/21
2005/0105397 A1 * 5/2005 Tuason ..... G04B 19/262 368/21

(Continued)

FOREIGN PATENT DOCUMENTS

FR 2652425 A1 3/1991
FR 2875021 A1 3/2006

(Continued)

OTHER PUBLICATIONS

Takahashi, K. et al., "Next Standard Watch Seiko Astron", GoodsPress, Jul. 10, 2013, pp. 75-81 with English translation.

(Continued)

*Primary Examiner* — Amy Cohen Johnson
*Assistant Examiner* — Jason Collins
(74) *Attorney, Agent, or Firm* — Harness, Dickey & Pierce, P.L.C.

(57) ABSTRACT

An electronic timepiece has an outside perimeter part disposed around a dial, hands, and a control unit. Further, 40 to 60 time zone indicators including time difference information representing the time difference between Coordinated Universal Time (UTC) and the standard time used in each time zone are on the outside perimeter part. The control unit indicates a specific time zone indicator with a hand.

17 Claims, 8 Drawing Sheets

(56) References Cited

U.S. PATENT DOCUMENTS

| | | | | |
|---|---|---|---|---|
| 2006/0140056 | A1* | 6/2006 | Lizzi | G04B 19/22 368/21 |
| 2006/0171256 | A1* | 8/2006 | Herbert | G04B 19/22 368/21 |
| 2006/0285443 | A1* | 12/2006 | Vogt | G04B 19/22 368/21 |
| 2007/0008822 | A1* | 1/2007 | Chen | G04B 19/23 368/21 |
| 2008/0056070 | A1* | 3/2008 | Lin | G04G 9/0076 368/21 |
| 2008/0130418 | A1 | 6/2008 | Clervoy | |
| 2009/0135675 | A1* | 5/2009 | Akiyama | G04G 9/0076 368/14 |
| 2010/0074059 | A1* | 3/2010 | Hasumi | G04C 3/008 368/47 |
| 2012/0075960 | A1* | 3/2012 | Sun | G04B 19/23 368/21 |
| 2014/0086027 | A1* | 3/2014 | Yanagisawa | G04R 60/10 368/278 |
| 2014/0321247 | A1* | 10/2014 | Cattaneo | G04B 19/223 368/27 |

FOREIGN PATENT DOCUMENTS

| | | | |
|---|---|---|---|
| GB | 2236413 | A | 4/1991 |
| JP | 2009-175044 | A | 8/2009 |
| JP | 2009-229106 | A | 10/2009 |

OTHER PUBLICATIONS

Extended European Search Report for Patent Application No. EP 14194917.2, dated Oct. 21, 2015 (7 pages).

* cited by examiner

10

ELECTRONIC TIMEPIECE

BACKGROUND

1. Technical Field

The present invention relates to an electronic timepiece.

2. Related Art

Electronic timepieces that use satellite signals to calculate the current location, and display the time zone at the current location (a geographical area that uses a common standard time), the standard time used in that time zone, and the time difference to UTC (Coordinated Universal Time), are known. JP-A-2009-175044, for example, discloses a wristwatch that has a plurality of hands and a dial on which a map is displayed, and creates an intersection of plural hands on the map to indicate the current location.

A wristwatch that shows 39 time zones around the outside of the dial, and indicates the time zone of the current location with a hand, is also described in the July 2013 issue of GoodsPress (Tokuma Shoten, 10 Jul. 2013, pp. 75-81; in Japanese). This wristwatch has a receiver unit that receives satellite signals from a GPS (Global Positioning System) or other navigational satellites, and receives signals from four navigational satellites to acquire location and time information for the current location, set the local time zone, and displays the current local time.

However, there are currently 40 different time zones around the world. The electronic timepieces described in JP-A-2009-175044 and the July 2013 issue of GoodsPress are therefore not compatible with all of the time zones used around the world.

SUMMARY

The present invention is directed to solving at least part of the foregoing problem as described in the embodiments and examples below.

An electronic timepiece according to this example has an outside perimeter part disposed around a dial; hands; and a control unit; wherein 40≤60 time zone indicators including time difference information representing the time difference between Coordinated Universal Time (UTC) and the standard time used in each time zone are expressed on the outside perimeter part; and the control unit indicates a specific time zone indicator with the hand.

The electronic timepiece according to this example has time zone indicators including time difference information expressed on an outside perimeter part disposed around the dial. An electronic timepiece with a typical analog display has a scale with 60 markers for indicating the hour and minute around the outside of the dial. This scale can be used to express 40 or more time zone indicators including time difference information representing the time difference between Coordinated Universal Time (UTC) and the standard time. The electronic timepiece can therefore indicate the time in time zones (the standard time in a particular time zone) with greater than or equal to 40 and less than or equal to 60 time differences to UTC by the control unit setting hands to a specific time zone indicator (marker) and the time. An electronic timepiece that is compatible with every time zone around the world can therefore be provided.

In an electronic timepiece according to another example, the outside perimeter part is at least one of a bezel and a dial ring.

In this example, the outside perimeter part is at least one of a bezel around the crystal, and a dial ring around the inside circumference of the crystal. The parts located on the outside perimeter part of the dial in a wristwatch-type electronic timepiece have a comparatively wide display area around the minute and second scale of the dial, and this area can therefore be used to express time zone indicators that are easy to read and contain a lot of information.

In an electronic timepiece according to another example, the number of time zone indicators is equal to the number of time zones used around the Earth.

In this example, the number of time zone indicators shown on the electronic timepiece is equal to the number of time zones used around the world. For example, by setting time difference information expressing the time difference of the standard time used in 40 different time zones on the scale that shows the hour and minute on the outside perimeter part disposed around the dial, the appropriate time can be displayed in each of the 40 time zones that are used around the world. Furthermore, because up to 60 different time differences can be set, the electronic timepiece according to this example can display the appropriate time in up to 60 different time zones, and can display the appropriate time even if a new region (time zone) using a different standard time than the standard times that are currently used is created.

In an electronic timepiece according to another example, the time difference information is expressed by numbers and non-numeric symbols.

The electronic timepiece according to this example expresses the time difference information with numbers and non-numeric symbols. As a result, time difference information that is easy to read and contains a lot of information can be expressed in a limited space.

In an electronic timepiece according to another example, the time difference information is expressed by a number when the time difference information is an integer value, and by a symbol when the time difference information is not an integer value.

This electronic timepiece according to this example expresses the time difference using numbers or non-numeric symbols depending on whether or not the time difference is an integer value. The time difference between UTC and the standard time used in some time zones cannot be expressed by a whole number. In India, for example, a time difference of +5.5 hours (+5 hours 30 minutes) is used. Because space for expressing time difference information is limited in a wristwatch-type electronic timepiece, the number of displayed letters can be reduced by using symbols for non-integer time differences, and time difference information that is easy to read and contains a lot of information can be expressed in a limited space.

In an electronic timepiece according to another example, the time zone indicators include the time difference information of UTC+8.75 hours.

By setting time difference information for 40 time zones, specifically the 39 time zones with which conventional electronic timepieces are compatible plus a new time zone with a time difference of +8.75 hours (+8 hours 45 minutes), on the scale indicating minutes and seconds on the outside perimeter part disposed around the dial, for example, the electronic timepiece according to this example can indicate the correct time in every time zone around the world.

In an electronic timepiece according to another example, the time zone indicators include city name information expressing a name of a representative city using the standard time appropriate to the time difference.

The time zone indicators in this example include time difference information expressing the time difference, and city information expressing the name of a representative city in the time zone using the standard time with the same time difference. As a result, the user of the electronic timepiece can easily know the time difference in the representative city from the city information.

An electronic timepiece according to another example preferably also has a storage unit that stores location information and time information for the current location obtained from an external signal. Time zone information including information about the time difference contained in the time difference information, and a geographical region that uses the standard time corresponding to the time difference, is stored in the storage unit; and the control unit sets the time zone of the current location based on the location information, the time information, and the time zone information.

An electronic timepiece according to this example can acquire the time zone of the current location and the standard time (current local time) used in that time zone by, for example, receiving external signals from four GPS satellites and comparing the location information calculated from the received signals, the time information, and the time zone information stored in the storage unit. By setting the time zone of the current location, the control unit can display the current time appropriate to the time zone of the current location.

An electronic timepiece according to another example preferably enables manually setting the time zone of the current location.

Because the electronic timepiece according to this example has a function for setting the time zone manually, the electronic timepiece can be manually set to the correct time zone. For example, when the time zone of the current location is not correctly set in the electronic timepiece because of error in location information near the border of the time zone, this configuration enables manually setting the correct time zone in the electronic timepiece. As a result, the electronic timepiece can display the current local time appropriately to the time zone of the current location.

An electronic timepiece according to another example of the invention is compatible with 40≤60 time zones.

The electronic timepiece according to this example can display the standard time in 40≤60 time zones. An electronic timepiece that is compatible with every time zone in the world can therefore be provided.

Other objects and attainments together with a better understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures. Note that the scale of various layers and parts of the electronic timepiece differ from the actual scale shown in the figures in order to illustrate the layers and parts in a size enabling better recognition and understanding.

Preferred Embodiment

Figure 1:
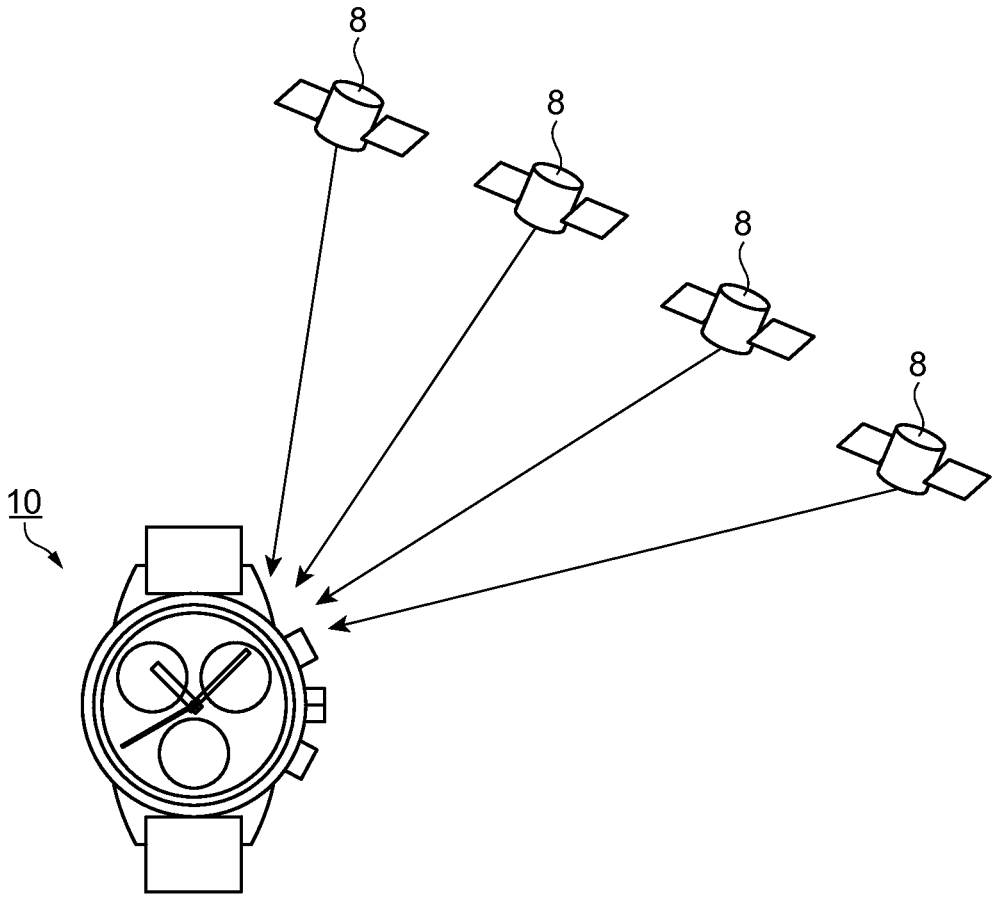
FIG. 1 illustrates an application of a GPS system including an electronic timepiece according to the invention.

FIG. 1 illustrates a GPS including an electronic timepiece according to an embodiment of the invention. The basic configuration of the GPS whereby an electronic timepiece operating as a GPS receiver receives RF signals from the GPS satellites to obtain location information and time information for the current location is described first.

The electronic timepiece 10 in this embodiment of the invention is a wristwatch that receives RF signals (satellite signals) from GPS satellites 8, and adjusts the internal time and displays the current time on the opposite side of the wristwatch (the face) as the side of the wristwatch worn in contact with the wrist (the back).

The GPS satellites 8 are navigational satellites that orbit the Earth in space on specific orbits, and broadcast a navigation message superimposed on a 1.57542 GHz carrier wave (L1 wave). For brevity below, the 1.57542 GHz carrier wave to which the navigation message is superimposed is referred to as the satellite signal. The satellite signals are right-hand circularly polarized waves.

There are presently 31 GPS satellites 8 in orbit (only 4 are shown in FIG. 1), and to identify which of the GPS satellites 8 transmitted the received satellite signal, a unique 1023 chip (1 ms) pattern called a C/A code (Coarse/Acquisition Code) is superimposed by each GPS satellite 8. Each chip in the C/A code denotes a +1 or −1, and the C/A code appears as a pseudorandom pattern. Therefore, by determining the correlation between the satellite signal and the pattern of each C/A code, the C/A code superimposed in a particular satellite signal can be detected.

Each GPS satellite 8 carries an atomic clock, and extremely precise GPS time information that is kept by the atomic clock is embedded in each satellite signal. The slight time difference between the atomic clocks carried by the GPS satellites 8 is measured by a land-based control segment, and a time correction parameter for correcting the particular time difference is included in each satellite signal.

The electronic timepiece 10 receives a satellite signal transmitted from one GPS satellite 8, and sets the internal time of the electronic timepiece 10 to the precise time (time information) obtained using the GPS time information and time correction parameter contained in the received satellite signal.

Orbit information identifying the location of the GPS satellite 8 on its orbit is also contained in the satellite signal. The electronic timepiece 10 performs a positioning calculation using the GPS time information and orbit information. This positioning calculation assumes there is a certain amount of error in the internal time of the electronic timepiece 10.

More specifically, in addition to the x, y, z parameters for acquiring the location of the electronic timepiece 10 in three dimensions, the time difference is also an unknown variable. The electronic timepiece 10 therefore generally receives satellite signals transmitted from four or more GPS satellites 8, and runs the positioning calculation using the GPS time information and orbit information contained in the received satellite signals to determine the location information of the current location.

Figure 2:
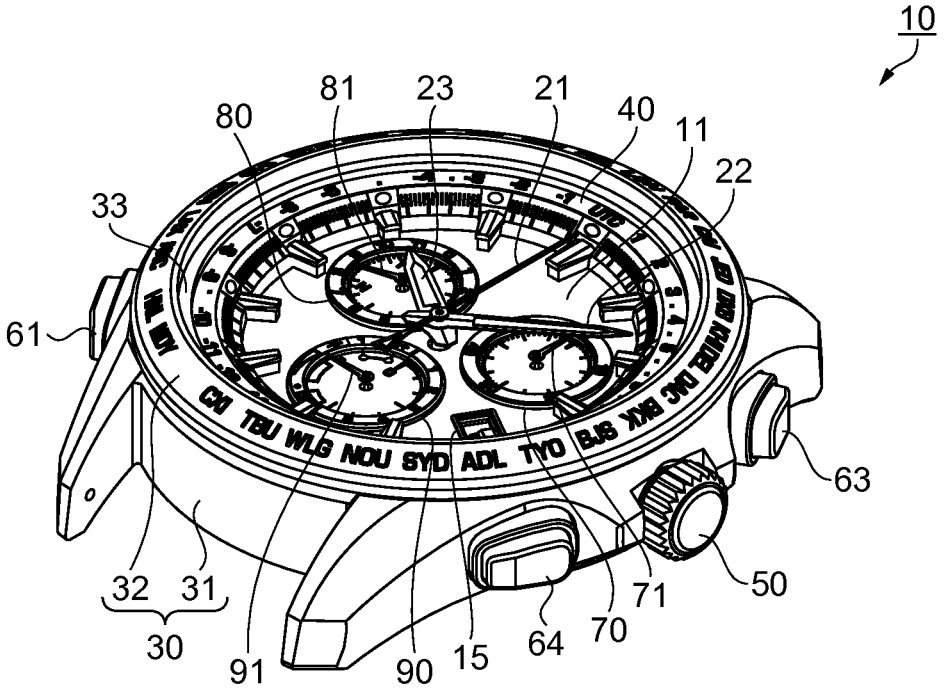
FIG. 2 is a perspective view showing an overview of an electronic timepiece.

The basic configuration of the electronic timepiece 10 is described next. FIG. 2 is a perspective view showing the appearance of the electronic timepiece 10, FIGS. 3A-F show six views of the appearance of the electronic timepiece 10, and FIG. 4 is a partial section view showing the configuration of the electronic timepiece 10.

Figures 3A, 3B, 3C, 3D, 3E, 3F:
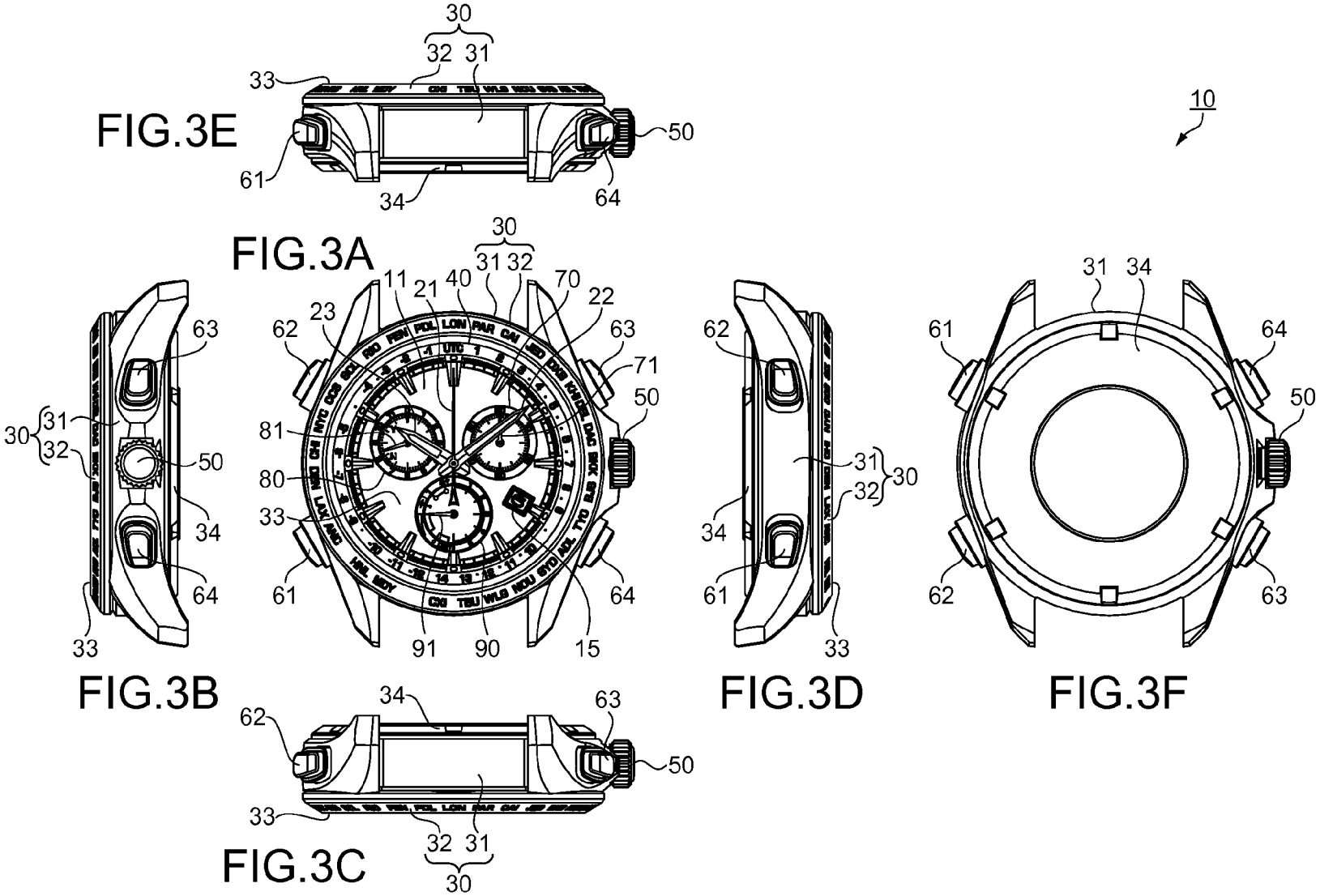
FIGS. 3A-F show six different views of the electronic timepiece.
Figure 4:
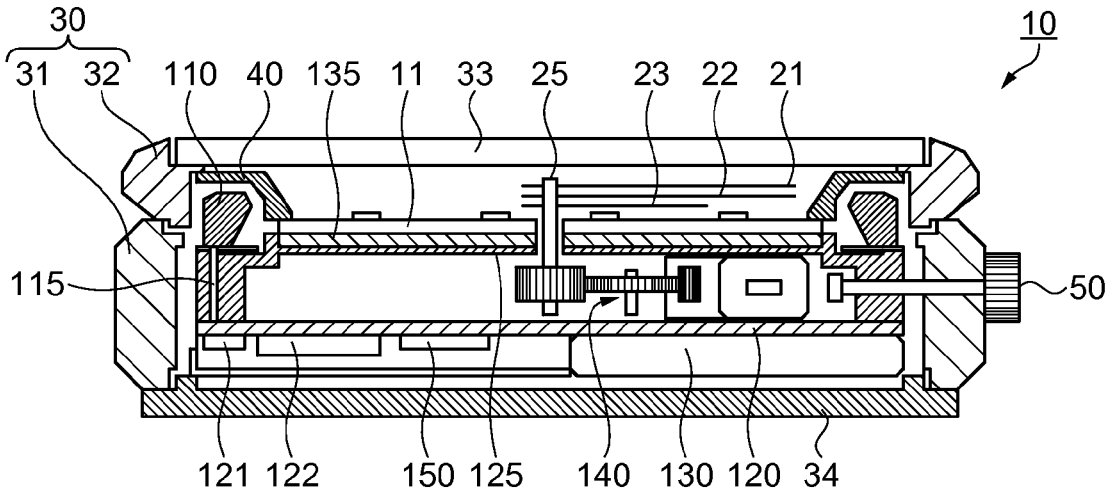
FIG. 4 is a section view showing part of the electronic timepiece.

Note that FIG. 3A is a plan view of the electronic timepiece from the face side, and FIG. 3B is a side view looking from the 3:00 position to the 9:00 position. FIG. 3C is a side view looking from the 12:00 position to the 6:00 position. FIG. 3D is a side view looking from the 9:00 position to the 3:00 position. FIG. 3E is a side view looking from the 6:00 position to the 12:00 position. FIG. 3F is a plan view of the back of the electronic timepiece 10.

The electronic timepiece 10 according to this embodiment has a world time function and a chronograph function.

As shown in FIG. 2 and FIGS. 3A-F, the electronic timepiece 10 has an outside case 30, a crystal 33, and a back cover 34.

The outside case 30 includes a ceramic bezel 32 fit to a tubular case member 31 preferably made of metal. A disc-shaped dial 11 is disposed as the time display part through a plastic annular dial ring 40 on the inside circumference side of the ceramic bezel 32. In this embodiment, the ceramic bezel 32 and the dial ring 40 correspond to the outside perimeter of the dial 11.

Hands 21, 22, 23 are disposed above the dial 11. Around the center of the dial 11 are further disposed a round first subdial 70 and hand 71 at 2:00; a round second subdial 80 and hand 81 at 10:00; a round third subdial 90 and hand 91 at 6:00; and a rectangular calendar window 15 at 4:00. The dial 11, hands 21, 22, 23, first subdial 70, second subdial 80, third subdial 90, and calendar window 15 can be seen through the crystal 33.

A button 61 is disposed to the side of the outside case 30 at 8:00 from the center of the dial 11; a button 62 is disposed at 10:00; a button 63 is disposed at 2:00; a button 64 is disposed at 4:00; and a crown 50 is disposed at 3:00. When the button 61, button 62, button 63, button 64, and crown 50 are operated, operating signals corresponding to the specific operation are output.

As shown in FIG. 4, of the two main openings in the outside case 30, the opening on the face side of the electronic timepiece 10 is covered by the crystal 33 through the intervening ceramic bezel 32, and the opening on the back side is covered by the back cover 34 which is preferably metal.

Disposed inside the outside case 30 are the dial ring 40 attached to the inside circumference of the ceramic bezel 32; an optically transparent dial 11; a center arbor 25 that passes through the dial 11; the hands 21, 22, 23 that rotate on the center arbor 25; and a drive mechanism 140 that drives the hands 21, 22, 23.

The center arbor 25 passes through the center of the outside case 30 in plan view, and is disposed on the center axis between the face and back of the timepiece.

The dial ring 40 has a flat portion of which the outside edge contacts the inside circumference surface of the ceramic bezel 32 and one surface is parallel to the crystal 33; and a beveled portion that slopes toward the dial 11 so that the inside edge contacts the dial 11. The dial ring 40 is ring-shaped when seen in plan view, and conically shaped (e.g., frusto-conical) when seen in section view. A donut-shaped storage space is formed by the flat portion and the beveled portion of the dial ring 40, and the inside circumference surface of the ceramic bezel 32. A ring antenna 110 is housed in this storage space.

The antenna 110 has a ring-shaped dielectric base on which a metal antenna pattern is formed by, for example, plating or silver paste printing. The antenna 110 is disposed around the perimeter of the dial 11 and the inside circumference side of the ceramic bezel 32, is covered by the plastic dial ring 40 and crystal 33, and can therefore assure good reception. The dielectric in this embodiment is molded from a titanium oxide or other high frequency dielectric material mixed with resin, and enables rendering a small antenna by using the wavelength-shortening effect of the dielectric.

The dial 11 is a round disc for indicating the time inside the outside case 30, is made from plastic or other suitable material, and is disposed inside the dial ring 40 with the hands 21, 22, 23 between the dial 11 and the crystal 33.

A photovoltaic solar panel 135 is disposed between the dial 11 and the ground plate 125 to which the drive mechanism 140 is attached. The solar panel 135 is a round panel having a plurality of solar cells (photovoltaic elements) that convert light energy to electrical energy connected in series. The solar panel 135 also has a sunlight detection function. Holes through which the center arbor 25, arbors (not shown in the figure) for the hand 71 of the first subdial 70, the hand 81 of the second subdial 80, and the hand 91 of the third subdial 90 pass, and the aperture of the calendar window 15, are formed in the dial 11, the solar panel 135, and the ground plate 125.

The drive mechanism 140 is attached to the ground plate 125, and is covered on the back side by a circuit board 120. The drive mechanism 140 has a stepper motor and a wheel train of wheels, and drives the hands 21, 22, 23 by the stepper motor turning the center arbor 25 through the wheel train. The hand 71 of the first subdial 70, the hand 81 of the second subdial 80, and the hand 91 of the third subdial 90 shown in FIG. 2 and FIG. 3 have similar drive mechanisms (not shown in the figure) that drive the hands 71, 81, 91.

The circuit board 120 has a balun 121, receiver unit (GPS module) 122, control unit 150, and a lithium ion or other storage battery 130. The storage battery 130 is charged by power produced by the solar panel 135. The circuit board 120 and antenna 110 are connected through an antenna connection pin 115. The balun 121 is a balanced-unbalanced conversion element that converts balanced signals from the antenna 110 operated with a balanced power supply to unbalanced signals that can be handled by the receiver unit 122.

The antenna 110 is powered through a power supply node, and the antenna connection pin 115 disposed on the back side of the antenna 110 is connected to this power supply node. The antenna connection pin 115 is a metal pin-shaped connector that is disposed to the circuit board 120 and passes through a through-hole formed in the ground plate 125 into the storage space. The circuit board 120 and the antenna 110 inside the storage space are connected to the antenna connection pin 115.

Figure 5:
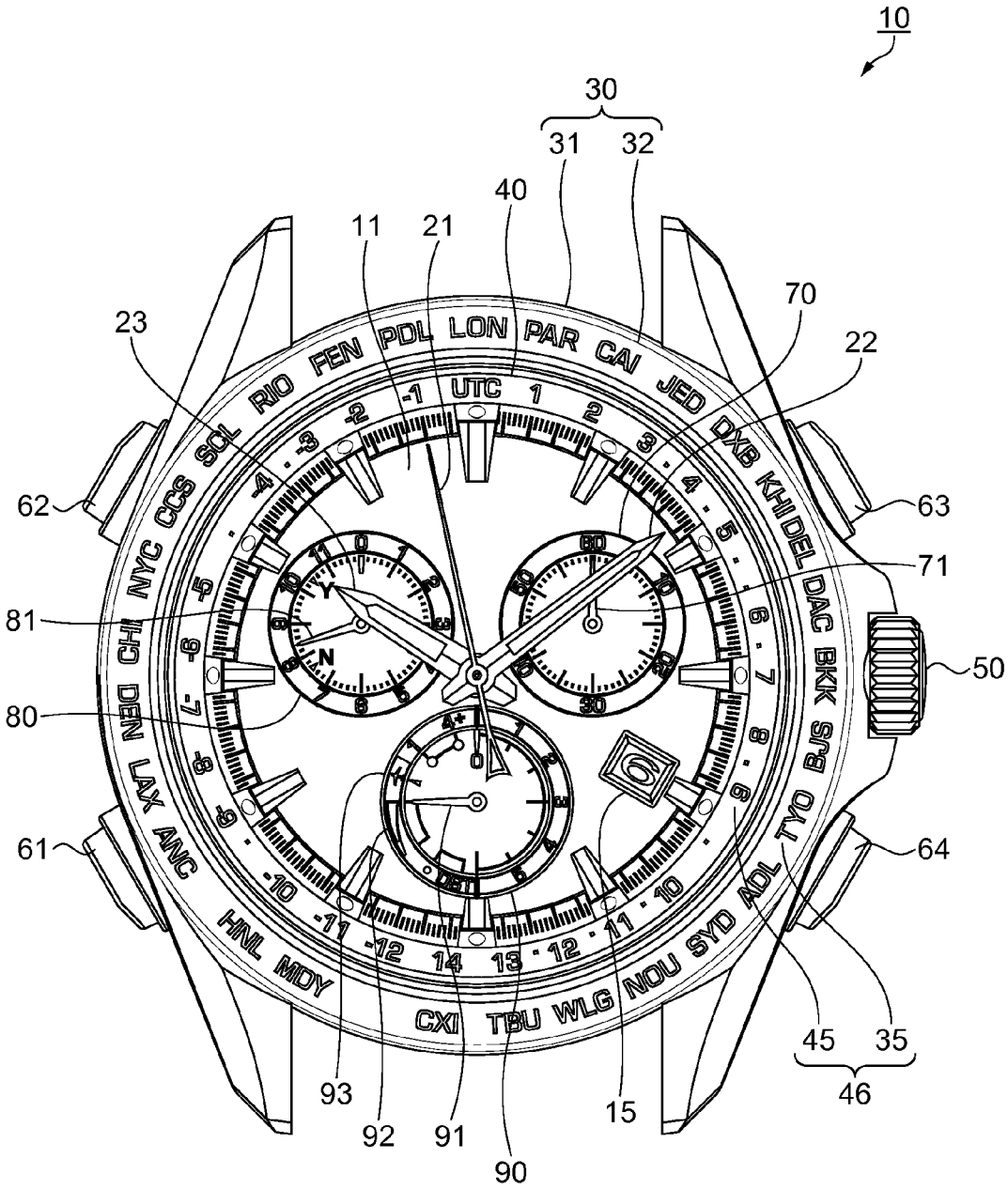
FIG. 5 is a plan view from the face of the electronic timepiece.

The display function of the electronic timepiece 10 is described next. FIG. 5 is a plan view of the electronic timepiece 10 from the face side.

As shown in FIG. 5, a scale dividing the outside circumference into 60 divisions, each of which is subdivided into a ⅕ scale of 5 divisions, is formed around the outside perimeter of the dial 11. Using this scale, the second hand 21 indicates the seconds of the chronograph function, the minute hand 22 indicates the minute of the internal clock, and the hour hand 23 indicates the hour of the internal clock. The chronograph function can be used by operating button 63 and button 64.

A scale of 60 divisions with numeric markers 10 to 60 at increments of 10 is disposed around the outside of the round first subdial 70 on the dial 11. The hand 71 of this first subdial 70 uses this scale to indicate the minute of the chronograph function.

A scale of 60 divisions with numeric markers 0 to 11 is disposed around the outside of the round second subdial 80 on the dial 11. The hand 81 of this second subdial 80 uses this scale to indicate the second of the internal clock.

The letter Y is disposed to the 52-second position and the letter N is disposed to the 38-second position of the second subdial 80. These letters are used to indicate the result of satellite signal reception (Y=reception succeeded, N=reception failed), and the satellite signal automatic reception mode (Y=automatic reception is ON, N=automatic reception is OFF). When the operator operates button 62, the hand 81 jumps to either Y or N according to the result of satellite signal reception. The automatic reception mode can be turned ON/OFF by the operator operating button 61 and button 62 to set the hand 81 to Y or N as desired. When the operator operates button 62 to manually command satellite signal reception by the electronic timepiece 10, the hand 81 indicates the number of captured satellites.

Note that a Y marker is at the 52-second position and an N marker is at the 38-second position in this embodiment, but the invention is not so limited. The Y and N markers are preferably disposed to positions that are easy to see according to the position where the subdial including the reception result display is disposed.

The markers around the round third subdial 90 on the dial 11 are described next. Note that the expression "n:00 position" (where n is a desirable natural number) used in the following description of the third subdial 90 denotes the direction (position) on the outside of the circle from the center of the third subdial 90.

A scale of six divisions with numeric markers 0 to 5 is formed on the outside perimeter of the third subdial 90 from 12:00 to 6:00. Using this scale, the hand 91 indicates the hour of the chronograph function.

The chronograph function in this embodiment can count time to 5 hours 59 minutes 59 seconds using hands 21, 71, 91.

The letters DST and an open circle (O) are disposed to the third subdial 90 in the area from 6:00 to 7:00. DST denotes Daylight Savings Time (also known as summer time). These markers are used to indicate if daylight savings time is being used (DST=daylight savings time is in use; O indicates daylight savings time is not in use). The operator can set the DST mode of the electronic timepiece 10 on or off by operating the crown 50 and button 62 to set the hand 91 to DST or O appropriately.

A sickle-shaped marker 92 that is wide at the base at 9:00 and narrows to the end at 7:00 is disposed along the outside edge of the third subdial 90 from 7:00 to 9:00. This marker 92 is a power indicator for the storage battery 130 (FIG. 4), and the hand 91 indicates a position at the base, middle, or tip of the marker 92 according to the reserve power in the storage battery 130.

An airplane-shaped marker 93 is disposed in the area from 9:00 to 10:00 on the outside of the third subdial 90. This airplane marker 93 denotes an in-flight mode. Satellite signal reception is prohibited in some countries by aviation regulations during take-off and landing of an airplane. Satellite signal reception by the electronic timepiece 10 can be stopped by the user operating the button 61 and setting the hand 91 to the airplane marker 93 (in-flight mode).

Numeric markers 1 and 4, and a +marker are disposed in the area from 10:00 to 12:00 on the outside of the third subdial 90. These numbers and marker are used to indicate the satellite signal reception mode. The 1 marker means that the GPS time information was received and the internal time corrected, and the 4+ marker means that GPS time information and orbit information were received, and the internal time and time zone described below were corrected. When the operator operates the button 62, the hand 91 jumps to the 1 or the 4+ marker to indicate the reception mode of the satellite signal that was just received by the electronic timepiece 10.

The calendar window 15 is a rectangular opening formed in the dial 11, and a number can be seen through the calendar window 15. This number indicates the day value of the current date.

The relationship between Coordinated Universal Time (UTC), the time difference, standard time, and the time zone is described next.

A time zone denotes a geographical area that uses a common standard time, and there are currently 40 time zones around the world. Each time zone is distinguished by the time difference between the standard time used in the time zone and UTC. Japan, for example, belongs in a time zone using a standard time that is 9 hours ahead of UTC, or UTC+9. The standard time used in each time zone can be obtained from UTC and the time difference to UTC.

As described above, a scale divided into 60 minutes and seconds is formed on the dial 11, and time difference information 45 representing the time difference to UTC is indicated by numbers and non-numeric markers along the time scale on the dial ring 40 surrounding the outside perimeter of the dial 11. The numeric time difference information 45 denotes the integer value of the time difference, and the non-numeric time difference information 45 denotes a time difference that is not a whole number. The time difference between UTC and the internal time indicated by hands 22, 23, 81 can be checked by the time difference information 45 indicated by the second hand 21 by operating the crown 50.

By assigning one time difference to one marker on the scale of 60 divisions on the dial 11, the electronic timepiece 10 can indicate an internal time corresponding to a maximum of 60 different time differences.

Note that in this embodiment of the invention the time difference information 45 at the UTC marker denotes Coordinated Universal Time, which is the standard time difference, and the time difference information 45 at the bullet (•) markers denotes time differences that are not whole numbers, but the invention is not so limited and other markers may be used instead.

In this embodiment, the time difference information 45 of the bullet (•) marker shown between the numbers 8 and 9 on the dial ring 40 denotes a time difference of +8.75 hours (+8 hours 45 minutes), and means a time zone that uses a standard time of UTC+8.75 hours. Including this standard time, there are currently 40 different time zones around the world, and the time difference in each of these 40 time zones is expressed on the dial ring 40 of the electronic timepiece 10. The number of time zone indications is preferably 60 or less. If the number exceeds 60, the markers become smaller and readability may become difficult.

City markers 35 each representing the name of a major city in the time zone using the standard time corresponding to the time difference of the time difference information 45 denoted on the dial ring 40 is displayed beside the time difference information 45 on the bezel 32 around the dial ring 40. The city markers 35 in this embodiment of the invention use three-letter codes that are three letter alphabetic abbreviations of the city names. More specifically, LON denotes London, PAR denotes Paris, CAI denotes Cairo, JED denotes Jeddah, DXB denotes Dubai, KHI denotes Karachi, DEL denotes Delhi, DAC denotes Dhaka, BKK denotes Bangkok, BJS denotes Beijing, TYO denotes Tokyo, ADL denotes Adelaide, SYD denotes Sydney, NOU denotes Noumea, WLG denotes Wellington, TBU denotes Nuku'alofa, CXI denotes Christmas Island, MDY denotes Midway Island, HNL denotes Honolulu, ANC denotes Anchorage, LAX denotes Los Angeles, DEN denotes Denver, CHI denotes Chicago, NYC denotes New York, CCS denotes Caracas, SCL denotes Santiago, RIO denotes Rio de Janeiro, FEN denotes Fernando de Noronha, and PDL denotes the Azores.

For example, the code TYO represents Tokyo, and that Tokyo uses a standard time of UTC+9 can be easily determined from the number 9 of the time difference information 45 corresponding to this city code displayed on the dial ring 40. Likewise, the code CXI represents Christmas Island, and that Christmas Island uses a standard time of UTC+14 can be easily determined from the number 14 of the time difference information 45 corresponding to this city code displayed on the dial ring 40.

Note that indication of a representative city name corresponding to the time difference of some time difference information 45 is omitted in this embodiment due to the limited display space and to improve readability.

The method of indicating representative city names is also simply one example, and representative city names may be indicated by other methods. The combined indications of the time difference information 45 and city markers 35 are referred to below as time zone indicators 46. This embodiment of the invention has the same number of time zone indicators 46 as the number of time zones around the world.

The electrical configuration of the electronic timepiece 10 is described next.

Figure 6:
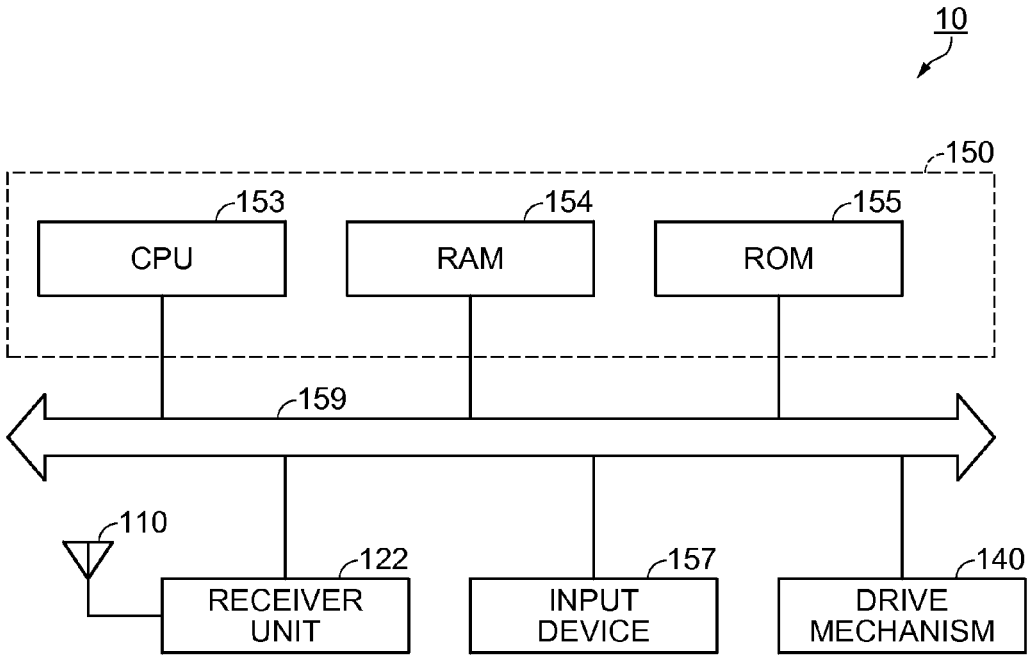
FIG. 6 is a block diagram illustrating the electrical control system of the electronic timepiece.

FIG. 6 is a block diagram of the electrical control system of the electronic timepiece. As shown in FIG. 6, the electronic timepiece 10 has a control unit 150 having a basic configuration including a CPU (central processing unit) 153, RAM (random access memory) 154, and ROM (read-only memory) 155; and peripheral devices including a receiver unit 122 (GPS module), an input device 157, and the drive mechanism 140. These devices exchange data through a data bus 159. The input device 157 includes the crown 50, button 61, button 62, button 63, and button 64 shown in FIG. 5. Note that the electronic timepiece 10 also has a rechargeable storage battery 130 (FIG. 4) as a power supply.

The receiver unit 122 includes the antenna 110, processes satellite signals received through the antenna 110, and acquires GPS time information and location information. The antenna 110 receives the radio waves of satellite signals that are transmitted from a plurality of GPS satellites 8 (see FIG. 1) orbiting the Earth in space on specific orbits and pass through the crystal 33 and dial ring 40 shown in FIG. 4.

As shown in the figure and similarly to a typical GPS receiver, the receiver unit 122 includes an RF (radio frequency) unit that receives and converts satellite signals transmitted from the GPS satellites 8 (FIG. 1) to digital signals; a baseband unit that executes a reception signal correlation process and demodulates the navigation message; and a data acquisition unit that acquires and outputs the GPS time information and location information (positioning information) from the navigation message (satellite signals) demodulated by the baseband unit. The receiver unit 122 thus functions as a receiver that receives satellite signals transmitted from the GPS satellites 8, and outputs GPS time information and location information based on the result of reception.

The RF unit includes a bandpass filter, PLL circuit, IF filter, VCO (voltage controlled oscillator), ADC (A/D converter), mixer, LNA (low noise amplifier), and IF amplifier.

The satellite signal extracted by the bandpass filter is amplified by the LNA, mixed by the mixer with the signal from the VCO, and down-converted to an IF (intermediate frequency) signal. The IF signal mixed by the mixer then passes through the IF amplifier and IF filter, and is converted by the A/D converter to a digital signal.

The baseband unit has a local code generator and a correlation unit.

The local code generator generates local codes that are the same as the C/A codes used by the GPS satellites 8 for signal transmission.

The correlation unit calculates the correlation between the local codes and the reception signal output from the RF unit. If the correlation calculated by the correlation unit equals or exceeds a specific threshold, the C/A code used in the received satellite signal and the local code that was generated match, and the satellite signal can be captured (synchronized). The navigation message can therefore be demodulated by the correlation process using the received satellite signal and a local code.

The data acquisition unit acquires the GPS time information and location information from the navigation message demodulated by the baseband unit. The navigation message contains preamble data, the TOW (Time of Week, also called the Z count) of the HOW word, and subframe data. There are five subframes, subframe 1 to subframe 5, and each subframe contains satellite correction data including a week number value and satellite health data, ephemeris data (detailed orbit information for a particular GPS satellite 8), and almanac data (basic orbit information for all GPS satellites 8). The data acquisition unit can therefore acquire the GPS time information and navigation information by extracting specific data from the received navigation message.

The RAM 154 and ROM 155 are the storage unit of the electronic timepiece 10.

A program run by the CPU 153 and time zone information are stored in ROM 155. The time zone information is data for managing location information (latitude and longitude) about geographical areas (time zones) using a common standard time, and the difference to UTC.

By running a program stored in ROM 155 using RAM 154 as working memory, the CPU 153 performs various calculation, control, and timekeeping operations. This timekeeping is done by counting the number of pulses in a reference signal from an oscillation circuit not shown, for example.

The CPU 153 corrects the internal clock based on the time information calculated from the GPS time and time correction parameter, the current location (longitude and latitude) calculated from the GPS time and orbit information, and the time zone information stored in ROM 155 (storage unit). The CPU 153 also controls driving the drive mechanism 140 so that the internal time is displayed. As a result, the internal time is displayed on the electronic timepiece 10 by the hands 22, 23, 81 (see FIG. 5).

Figure 7:
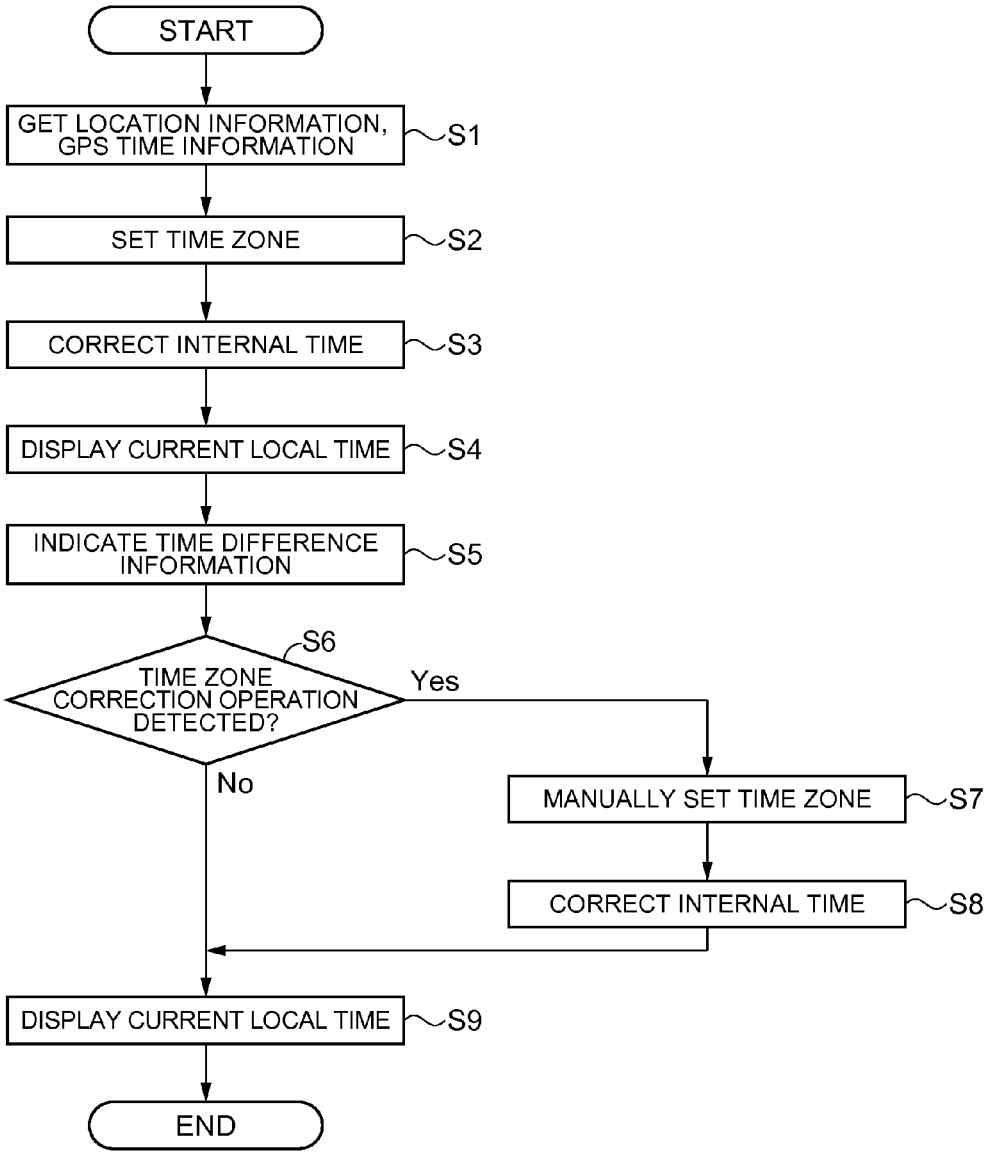
FIG. 7 is a flow chart illustrating the operation of the electronic timepiece.

Operation of the electronic timepiece 10 is described next. FIG. 7 is a flow chart showing the flow of the operation setting the time zone on the electronic timepiece 10.

First, in step S1, the CPU 153 drives the receiver unit 122 to receive satellite signals, acquire the GPS time and orbit information, and calculate the current location when the button 62 is operated or sunlight on the solar panel 135 is detected.

In step S2, the CPU 153 gets the time zone according to the current location. More specifically, the CPU 153 identifies the local time zone by comparing the location information with the time zone information described above, and sets (automatically sets) the time zone in the RAM 154.

In step S3, the CPU 153 corrects the internal time according to the set time zone. More specifically, the CPU 153 calculates UTC from the GPS time and time correction parameter contained in the satellite signal, calculates the current local time (the standard time of the time zone) by adding the time difference used in the set time zone to the calculated UTC, and sets the calculated local time as the internal time.

In step S4, the CPU 153 controls the drive mechanism 140 (FIG. 4) to display the current local time (internal time).

In step S5, the CPU 153 controls the drive mechanism 140 (FIG. 4) when operation of the crown 50 is detected so that the second hand 21 (FIG. 5) points to the time zone indicator 46 (FIG. 5) corresponding to the time zone set in step S2.

In step S6, the user determines if correcting the time difference (time zone) indicated by the hand 21 is necessary, and the CPU 153 determines if an operation commanding adjusting the time zone was performed. If the adjustment operation is detected (step S6 returns YES), control goes to step S7. If the adjustment operation is not detected (step S6 returns NO), control goes to step S9.

In step S7, the CPU 153 detects operation of the crown 50, drives the drive mechanism 140 (FIG. 4) to move the hand 21 to the time zone indicator 46 (FIG. 5) corresponding to the correct time zone selected by the user, and sets the correct time zone in RAM 154.

Note that this operation is referred to as manually setting the time zone because the user operates the crown 50 to select the desired time zone indicator 46 (FIG. 5).

In step S8, the CPU 153 corrects the internal time accordingly to the manually set time zone.

In step S9, the CPU 153 detects operation of the crown 50 and drives the drive mechanism 140 (FIG. 4) to display the current local time.

Note that operation of the input device 157 (button 61, button 62, button 63, button 64, crown 50) described in this embodiment is simply one example, and the same operations may be performed using a different input device.

This embodiment of the invention describes an electronic timepiece 10 using power generated by the solar panel 135 and a storage battery 130 as a drive power source, but the invention is not so limited and a primary battery or other type of charging method may be used instead. The mechanisms inside the outside case 30 can be simplified by using a primary battery as the power source. Further alternatively, by using a storage battery that stores power produced by electromagnetic induction or other charging method, the electronic timepiece according to the invention can be used even where there is insufficient light for photovoltaic generation, or where battery replacement is difficult.

The electronic timepiece 10 according to the invention as described above has the following effect.

Forty different time differences, including the time difference in a geographical area (time zone) that uses a standard time of UTC+8.75, are set on a scale representing minutes and seconds, and corresponding time zone indicators 46 are set on the dial ring 40 and bezel 32.

The electronic timepiece 10 also has functions for receiving satellite signals, and determining the time zone of the current location and displaying the current local time based on current location information and time information calculated from the received satellite signals. An electronic timepiece that can display the appropriate time in every time zone in the world (40 time zones) can therefore be provided.

The present invention is not limited to the foregoing embodiment, and can be varied in many ways by applying desirable changes or improvements to the foregoing embodiment. Some examples of such variations are described below.

Variations

Figure 8:
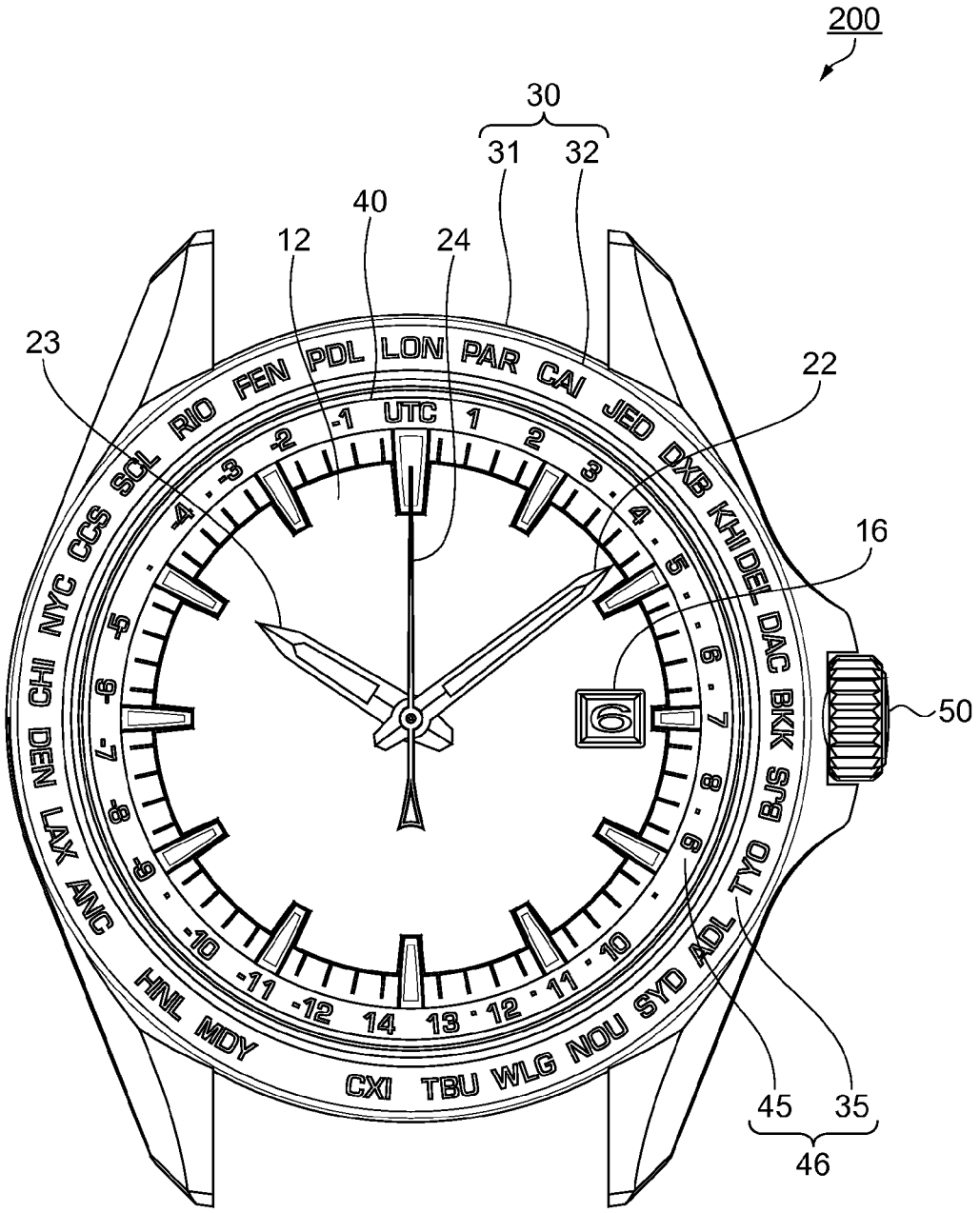
FIG. 8 is a plan view from the face of another example of an electronic timepiece.

FIG. 8 is a plan view showing an electronic timepiece according to a variation of the foregoing embodiment.

The electronic timepiece 10 according to the embodiment described above has a chronograph function as shown in FIG. 5, but the invention is not limited to such a configuration.

An electronic timepiece 200 according to a variation of the invention is described below. Note that like parts in this and the foregoing embodiment are identified by like reference numerals, and repetitive description thereof is omitted below.

As shown in FIG. 8, a scale dividing the perimeter into 60 divisions is formed around the outside of the dial 12. The hands 22, 23, 24 display the internal time using this scale.

A rectangular calendar window 16 that is easy to read is disposed at 3:00 on the dial 12. The calendar window 16 is an opening in the dial 12, and a number can be seen through this opening. This number indicates the day value of the current date.

Markers indicating the 60 minute and second divisions are expressed on the dial 12, and time zone indicators 46 for the 40 time zones used around the world are formed along the minute and second markers in the area around the outside edge of the dial 12. The time zone of the internal time indicated by the hands 22, 23, 24 can be confirmed from the time zone indicator 46 pointed to by the hand 24 that jumps when the crown 50 is operated.

The electronic timepiece 200 according to this embodiment of the invention has the following effect in addition to the effects of the first embodiment described above.

This electronic timepiece 200 has a world time function corresponding to 40 different time zones. By omitting a chronograph function, the operability and readability of an electronic timepiece 200 that is compatible with every time zone in the world can be improved.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2013-245797 filed Nov. 28, 2013 is expressly incorporated by reference herein.

What is claimed is:

1. An electronic timepiece comprising:

a dial;

an outside perimeter part disposed around the dial and being configured to include a bezel and a dial ring;

hands interior of the outside perimeter part; and a control unit operatively connected to the hands;

wherein 40 to 60 time zone indicators are on the outside perimeter part, each of the time zone indicators includes time difference information and a city marker, the time difference information representing a time difference between Coordinated Universal Time (UTC) and standard time used in each time zone and the city marker corresponding to the time difference information;

the time difference information is disposed on one of the dial ring and the bezel and the city marker is disposed on another of the dial ring and the bezel; and the control unit indicates one of the time zone indicators with one of the hands based on a geographical location of the electronic timepiece.

2. The electronic timepiece described in claim 1, wherein:

a number of time zone indicators is equal to 40 time zones.

3. The electronic timepiece described in claim 1, wherein:

the time difference information is expressed by numbers and non-numeric symbols.

4. The electronic timepiece described in claim 3, wherein:

the time difference information is expressed by a number when the time difference information is an integer value, and by a symbol when the time difference information is not an integer value.

5. The electronic timepiece described in claim 1, wherein:

the time zone indicators include the time difference information of UTC +8.75 hours.

6. The electronic timepiece described in claim 1, wherein:

the time zone indicators include city name information.

7. The electronic timepiece described in claim 1, further comprising:

a storage unit that stores location information and time information for a current location obtained from an external signal;

time zone information including information about a time difference contained in the time difference information, and a geographical region that uses the standard time corresponding to the time difference, is stored in the storage unit; and the control unit sets the time zone of the current location based on the location information, the time information, and the time zone information.

8. The electronic timepiece described in claim 1, wherein:

the time zone of a current location is manually settable.

9. The electronic timepiece described in claim 1, wherein the time difference information is disposed on the dial ring and the city marker is disposed on the bezel.

10. The electronic timepiece described in claim 1, wherein:

the city marker corresponding to the time difference information for at least one time zone indicator is omitted and the city marker corresponding to the time difference information for at least another time zone indicator is present.

11. An electronic timepiece comprising:

a dial;

a first ring concentrically encircling the dial;

a second ring concentrically encircling the first ring;

at least 40 time zone indicators on one of the first and second rings, each of the time zone indicators including a time offset between standard time in each time zone and Coordinated Universal Time;

city name information on another of the first and second rings, each city name information respectively corresponding to at least one of the time zone indicators;

a receiver unit receiving GPS satellite signals, acquiring GPS time and orbit information, and calculating a current location; and a control unit indicating:

current local time based on the GPS time and the current location; and one of the time zone indicators as a current local time zone based on the current location, wherein the first ring is a dial ring and the second ring is a bezel.

12. The electronic timepiece described in claim 11, wherein:

a number of the time zone indicators is equal to 40 time zones.

13. The electronic timepiece described in claim 11, wherein:

the time offset is expressed by numbers and non-numeric symbols.

14. The electronic timepiece described in claim 13, wherein:

the time offset is expressed by a number when the time offset is an integer, and by a symbol when the time offset is not an integer.

15. The electronic timepiece described in claim 11, wherein:

the time zone indicators include the time offset of UTC +8.75 hours.

16. The electronic timepiece described in claim 11, wherein the time zone indicators are disposed on the dial ring and the city name information is disposed on the bezel.

17. The electronic timepiece described in claim 11, wherein:

the city name information corresponding to the time offset for at least one time zone indicator is omitted and the city name information corresponding to the time offset for at least another time zone indicator is present.

* * * * *